United States Patent [19]

Knop et al.

[11] Patent Number: 4,920,913

[45] Date of Patent: May 1, 1990

[54] DEVICE FOR COATING A WEB OF MATERIAL

[75] Inventors: Reinhard Knop, Bochum; Herbert Sommer, Düsseldorf; Georg Müller, Neuss, all of Fed. Rep. of Germany

[73] Assignee: Jagenberg Aktiengesellschaft, Dusseldorf, Fed. Rep. of Germany

[21] Appl. No.: 226,175

[22] Filed: Jul. 29, 1988

[30] Foreign Application Priority Data

Aug. 1, 1987 [DE] Fed. Rep. of Germany ..... 3725545

[51] Int. Cl.[5] ..... B05C 1/04; B05C 3/12

[52] U.S. Cl. ..... 118/410; 118/413; 118/414; 118/419

[58] Field of Search ..... 118/407, 405, 410, 409, 118/413, 416, 419, 415, 107, 118, 119, 414, 420, 423

[56] References Cited

U.S. PATENT DOCUMENTS

| | | | |
|---|---|---|---|
| 3,273,535 | 9/1966 | Krikorian | 118/410 |
| 3,633,292 | 5/1972 | Herzhoff et al. | 118/410 |
| 4,133,293 | 1/1979 | Smejda | 118/413 |
| 4,250,211 | 2/1981 | Damrau et al. | 427/356 |
| 4,369,731 | 1/1983 | Damrau | 118/413 |
| 4,387,663 | 6/1983 | Alheid | 118/413 |
| 4,440,105 | 4/1984 | Jeltema | 118/413 |
| 4,643,127 | 2/1987 | Wanke | 118/413 |
| 4,688,516 | 8/1987 | Sommer | 118/413 |

FOREIGN PATENT DOCUMENTS

| | | | |
|---|---|---|---|
| 3446526 | 8/1985 | Fed. Rep. of Germany . | |
| 8414904 | 3/1986 | Fed. Rep. of Germany . | |
| 3438380 | 4/1986 | Fed. Rep. of Germany . | |
| 3336553 | 7/1986 | Fed. Rep. of Germany . | |
| 3620374 | 2/1987 | Fed. Rep. of Germany . | |
| 3616645 | 11/1987 | Fed. Rep. of Germany | 118/410 |
| 2199516 | 7/1988 | United Kingdom | 118/420 |

*Primary Examiner*—Willard Hoag

*Attorney, Agent, or Firm*—Sprung Horn Kramer & Woods

[57] ABSTRACT

In a device for coating a web of material that travels around a backing roller, the device having a coating chamber that opens toward the backing roller, that extends over the operating width, that has a slot demarcated at the web-intake end by an overflow plate for supplying liquid coating, and having a flow-control system at the downstream end, the improvement which comprises structures defining a coating-guide channel that extends over the operating width at the outlet end of the coating chamber and terminates just upstream of the flow-control system, that is demarcated at one end by the backing roller and at the other by a baffle that essentially parallels the surface of the backing roller, that extends along the direction of travel at least 50% of the length of the overflow plate plus the flow-control system, that is open along its width perpendicular to the axis of the backing roller from 1.5 to 15% and preferably from 2.5 to 5% of its length, and that terminates just upstream of the flow-control system.

9 Claims, 4 Drawing Sheets

DEVICE FOR COATING A WEB OF MATERIAL

BACKGROUND OF THE INVENTION

The invention concerns a device for coating a web of material the coating being applied either directly to the web as it travels around the backing roller or indirectly, to the surface of a roller and thence to the web.

Nozzle-based devices are preferred for applying low-density ($<10$ g/m$^2$) coatings to papers traveling at high speeds ($>700$ m/min). Essential components of known generic nozzle-based coaters are a coating chamber that opens toward the backing roller and is supplied with liquid coating from a preliminary-distribution chamber through a gap that extends over the operating width and a flow-control system (usually involving a doctor blade) closing off the downstream end of the coating chamber.

The intake end of the coating chamber is demarcated by an overflow plate that terminates in the vicinity of the backing roller, leaving an overflow gap. The coating as it flows through the overflow gap prevents air from entering the coating chamber along with the web. The chamber is sealed off laterally at the ends of the backing roller by boards.

Coating devices of this type are described in German GM 8 424 904 and German Patent 3 336 553.

One drawback of the known nozzle-based coaters is that the quality of the coating is very poor at high speeds ($>800$ m/min). The higher the speed, the more serious the problems with spots, streaks, bubbles, etc.

SUMMARY OF THE INVENTION

The object of the invention is to improve such a coating device to the extent that a uniform coating of high quality can be applied at high paper speeds ($\leqq 2000$ m/min).

This object is attained by the improvement consisting of a coating-guide channel that extends over the operating width at the outlet end of the coating chamber and terminates just upstream of the flow-control system, that is demarcated at one end by the backing roller and at the other by a baffle that essentially parallels the surface of the backing roller, that extends along the direction of travel at least about 50% of the distances between the overflow plate and the flow-control system, that is open along its width perpendicular to the axis of the backing roller from about 1.5 to 15%, and preferably from about 2.5 to 5% of its length, and that terminates just upstream of the flow-control system.

It has been demonstrated that the aforesaid drawbacks can be affected in particular by how the liquid coating is supplied to the flow-control system. Unstable and random flow conditions directly upstream of the flow-control system can result in irregular coating. Such other factors as surges can occasion local coating-pressure and coating-rate fluctuations in the vicinity of the web, affecting not only the degree and uniformity of penetration but also the coating rheology and equilibrium of forces at the flow-control system and hence the coating pattern.

That the coating is channeled within a stabilized zone in accordance with the invention makes for a more uniform distribution of pressure over the total area of penetration, which can be adjusted to ensure reproducibility. Since the zone in which the coating is channeled terminates just upstream of the flow-control system, the backflowing coating can be removed unimpeded and separate from the arriving coating, eliminating backflow in the channeling zone.

It has been demonstrated that the rate of circulation of rheologically problematic liquid coatings in accordance with the invention can be halved without detriment to the coating pattern relative to older designs in which the coating chamber opens directly into the flow-control system. This makes it possible to use considerably smaller pumps.

The device can have a channel through which the excess coating doctored off in the flow-control system can flow out and beginning at an acute angle to the opening between the baffle and the flow-control system.

The outflow channel can communicate with the intake through which fresh liquid coating is supplied.

The outflow channel can open into the coating chamber at an acute angle to the opening into the supply slot.

The distance between the end of the baffle and the flow-control system can be about 1.2 to 3 times the distance between the baffle and the surface of the backing roller or web of material.

The device can have a hollow component that extends over the operating width between the coating chamber and the outflow channel, communicates with the coating chamber through a slot-like opening, opens into the lines that supply fresh liquid coating, and has a surface that demarcates it from the backing roller and constitutes the baffle.

The device can have a flow-control system that consists of a doctor blade secured in a doctor beam that pivots around the point of the doctor blade.

The device can alternately have a flow-control system that consists of a doctor batten resiliently secured in a pivoting mount.

The device can alternately have a flow-control system with a rotating doctor rod resiliently secured in a mount.

BRIEF DESCRIPTION OF THE DRAWINGS

The invention will now be specified with reference to the drawings, wherein

FIG. 5 is a schematic sectional view of an overall coating system of the prior art.

DETAILED DESCRIPTION OF THE INVENTION

Figure 1:
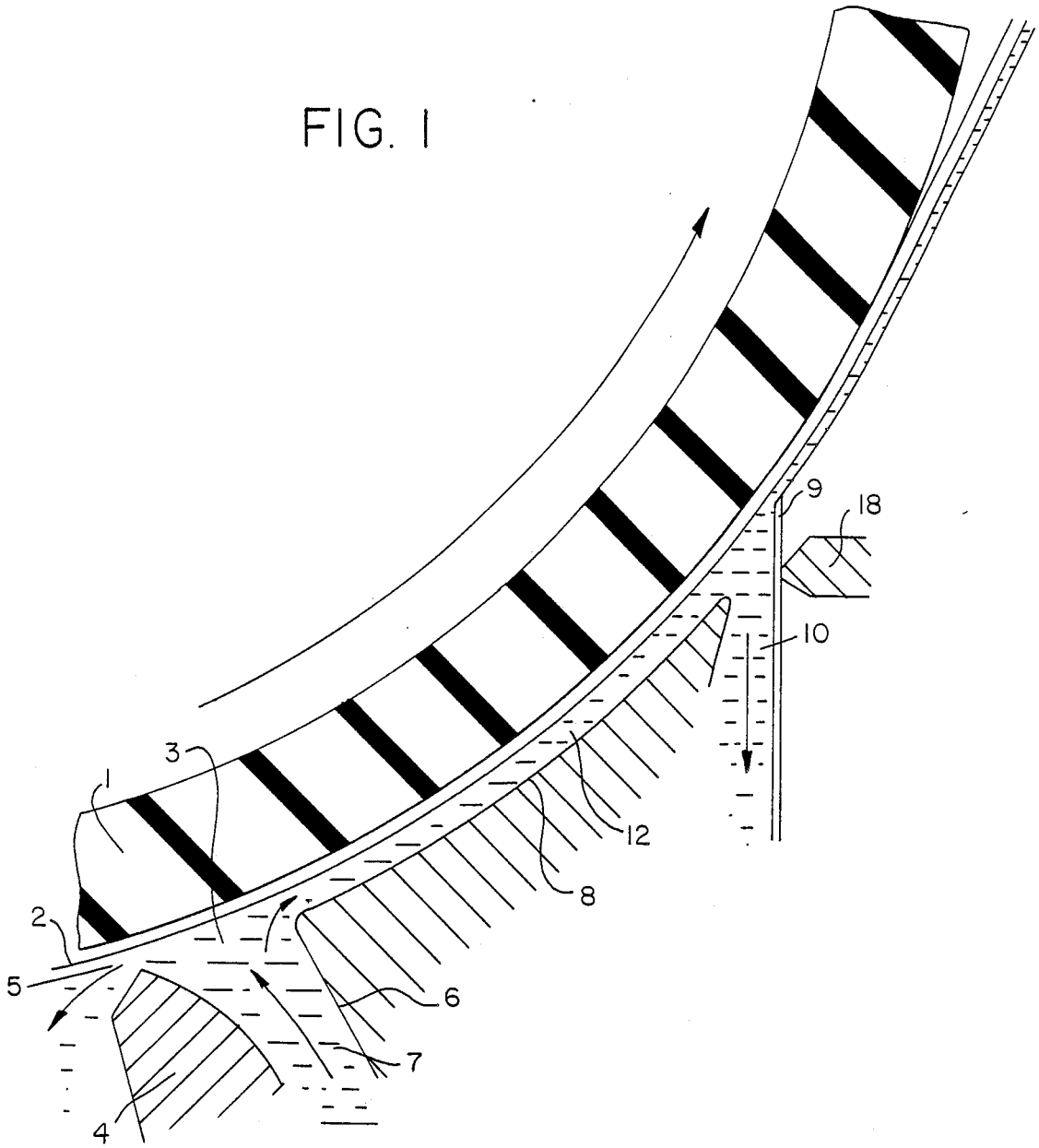
FIG. 1 is a schematic section through the vicinity of the backing roller in a coating device in accordance with the invention.

As employed hereinafter the baffle width relates to its dimension in the direction of roll movement, e.g. 8 as seen in FIG. 1 or perpendicular to the width of the baffle as defined above.

FIG. 5 is a schematic sectional view of a prior art coating system over which the present invention distinguishes. The pivoting cylinder and coating channel of such system are replaced by the instant coating channel as shown in FIGS. 1 to 4.

The function of all the embodiments of the invention described herein is to coat a web 2 of paper that travels around a backing roller 1. The coater, which is identical in section perpendicular to the axis of the backing roller and along its operating width, has a coating chamber 3 that is demarcated at the paper-intake end by an overflow plate 4 that terminates at a certain distance upstream of backing roller 1, leaving an overflow gap 5.

Figure 2:
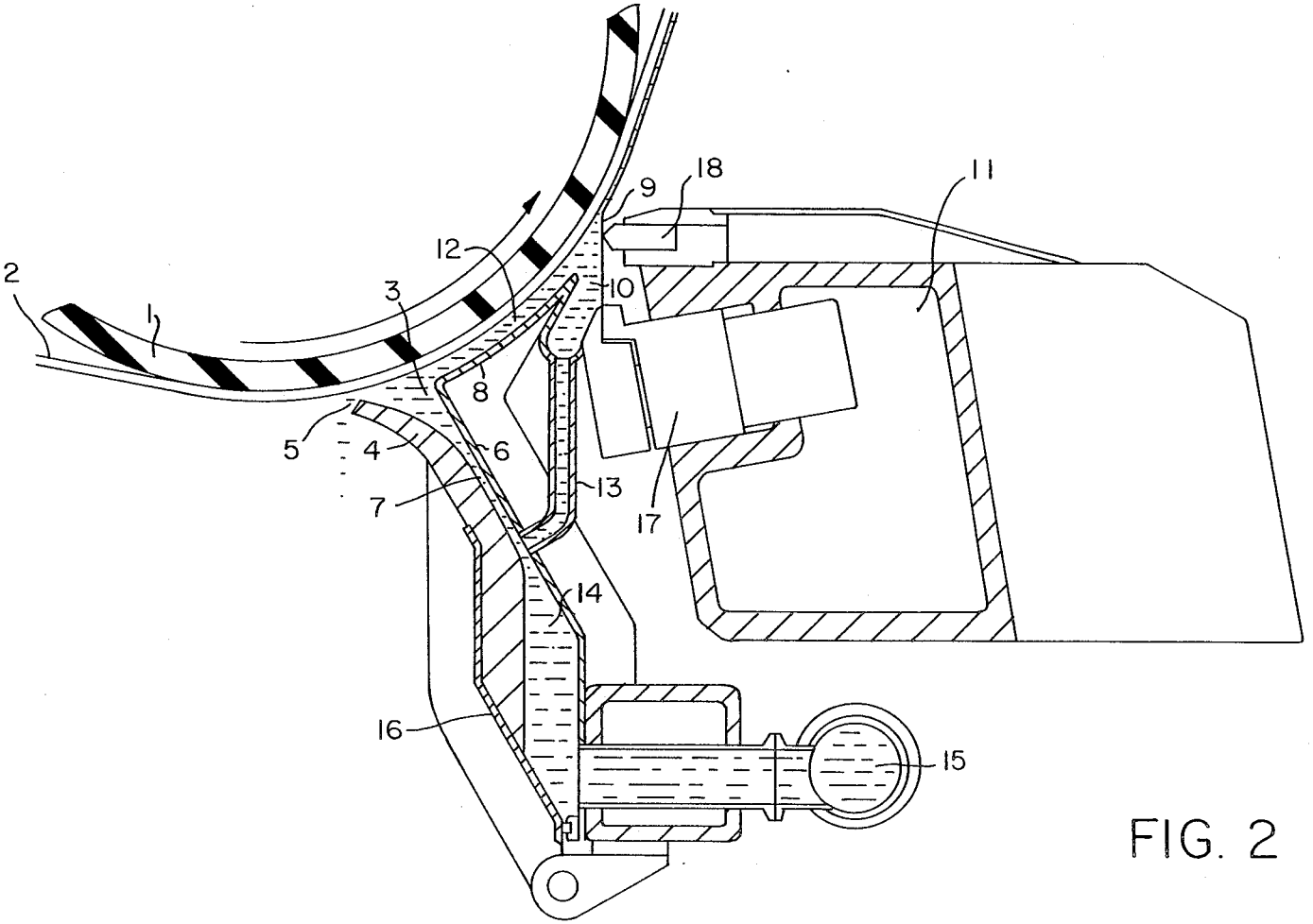
FIGS. 2 through 4 are sections through various embodiments of the invention.
Figure 3:
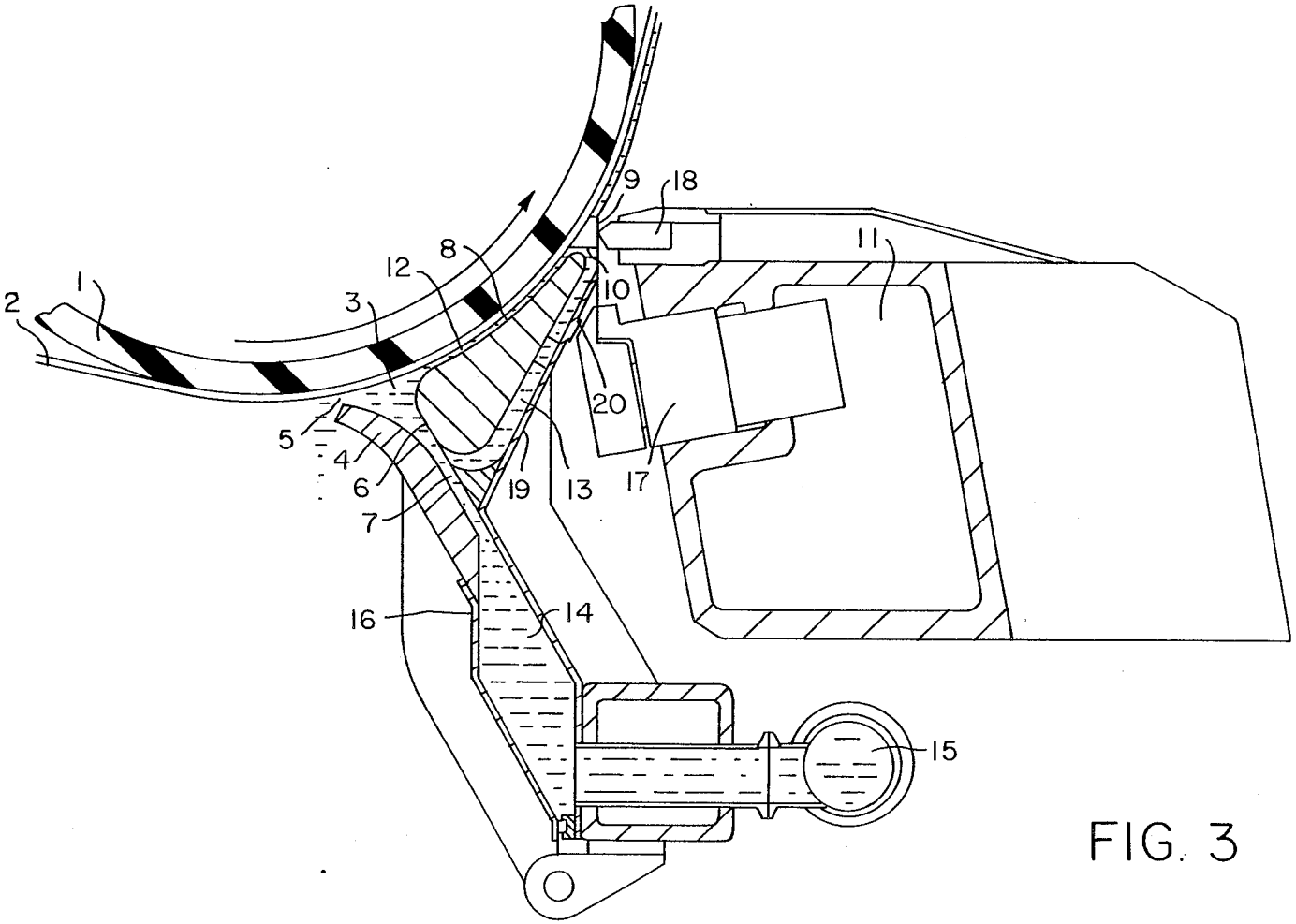
Figure 4:
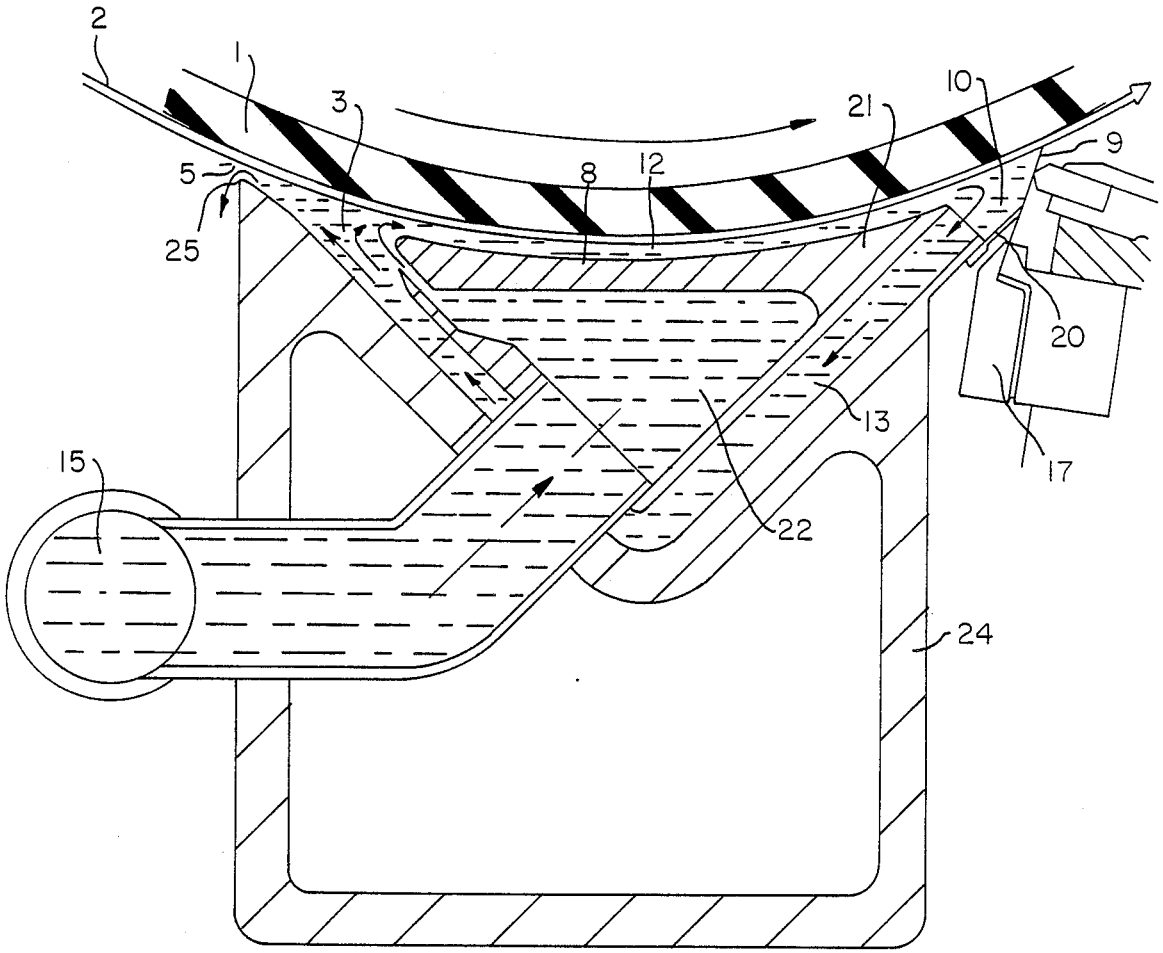

At the paper-outtake end the coating chamber is demarcated by a wall 6 that extends away from backing roller 1, leaving a slot 7 between overflow plate 4 and the wall through which liquid coating can be supplied. At an angle to wall 6 along the direction in which the paper travels is a baffle 8 that parallels or converges slightly (no more than 2°-3°) toward the surface of backing roller 1 and terminates just upstream of a flow-control system, leaving a channel 10 through which the excess liquid coating can flow out. The flow-control system in all the embodiments described herein is a doctor blade 9 secured in a pivoting doctor beam 11 (FIGS. 2 to 4). A flow-control system that utilizes a doctor batten resiliently secured in a pivoting mount or a rotating doctor could of course also be employed. Baffle 8 is at least 50% as long in the direction of travel as overflow plate 4 plus the flow-control system, i.e. to blade 9. A coating-guide channel 12 is created by backing roller 1 and baffle 8 and is open along its width perpendicular to the axis of the backing roller from 1.5 to 15% and preferably from 2.5 to 5% of the length of the baffle.

Outflow channel 10 is positioned at an acute angle to the opening between baffle 8 and the blade 9. The embodiment illustrated has backflow channels 13 that communicate with outflow channel 10 and open into a preliminary-distribution chamber 14, whence coating chamber 3 is supplied with fresh liquid coating through supply slot 7. The entrance into backflow channels 13 can preferably be positioned in the vicinity of the entrance into supply slot 7 to exploit the injector action of the fresh liquid coating flowing into coating chamber 3. Preliminary-distribution chamber 14 is supplied with liquid coating through a coating-supply system 15. The wall 16 that demarcates the intake end of preliminary-distribution chamber 14 accordingly simultaneously constitutes a mount for overflow plate 4 and can be folded up against the direction of travel for cleaning.

The foot of doctor blade 9 is secured in a movable tensioning batten 17 and rests below the flow-control point on another tensioning batten 18. Tensioning battens 17 and 18 are secured in doctor beam 11 which pivots around the flow-control point.

The backflow channel 13 that communicates with outflow channel 10 in the embodiment illustrated in FIG. 3 opens into coating chamber 3 at an acute angle to the opening into supply slot 7. Extending out of the demarcation 19 of outflow channel 10 is a resilient sealing lip 20 that rests against doctor blade 9. This design allows flow-control system 9, 11, 17 and 18 to pivot independent of the coater.

The width of outflow channel 10, i.e. the distance between baffle 8 and flow-control system 9, is between 1 and 15 mm.

The embodiment illustrated in FIG. 4 has a hollow component 21 that extends across the operating width and accommodates a preliminary-distribution chamber 22. Baffle 8 is constituted by the demarcation of hollow component 21 in relation to backing roller 1. The backflow channel 13 that communicates with outflow channel 10 extends around hollow component 21 and terminates directly in coating chamber 3. A supply slot 23 opens into coating chamber 3 parallel with or at an acute angle to backflow channel 13. There can if necessary be several outflow channels 10 and backflow channels 13. A supporting structure 24 supports hollow component 21 and the coating-supply system 15 that opens into preliminary-distribution chamber 22. The intake-end demarcation 25 of supporting structure 24 terminates just in front of backing roller 1, leaving overflow gap 5 open. Extending from the outtake-end demarcation of outflow channel 10 as in the embodiment illustrated in FIG. 3 is a sealing lip 20 that rests against flow-control system 9 to allow flow-control system 9 and 17 to pivot independent of supporting structure 24.

How the web 2 of paper that travels around backing roller 1 is coated will now be described. Liquid coating is applied to web 2 in coating chamber 3 and adjusted to the desired thickness by flow-control system 9. Coating is constantly supplied in excess through supply slot 7 or 23, keeping coating chamber 3 full. Excess coating escapes opposite the direction of travel through overflow gap 5 and prevents the layer of air entrained with the moving web from entering coating chamber 3. The flow-control system 9 at the end of the coater meters out the coating to the desired density by removing the excess portion through outflow channel 10. The excess is, in the embodiments illustrated in FIGS. 2 through 4, returned to the coating chamber or to the preliminary-distribution chamber. The coating is introduced into coating chamber 3 subject to increased pressure. The pressure drops rapidly at the exit from the coating chamber and accordingly at the beginning of coating-guide channel 12. The flow in coating-guide channel 12 is stationary between baffle 8 and coating-guide channel 12 and has a uniform pressure distribution. This adjustable and uniform distribution of pressure is maintained uninterrupted all the way to flow-control system 9, resulting in reproducible flow conditions over the total area of penetration.

It is understood that the specification and examples are illustrative but not limitative of the present invention and that other embodiments within the spirit and scope of the invention will suggest themselves to those skilled in the art.

We claim:

1. In a device for coating a web of material that travels around a backing roller having an operating width and an axis of rotation, including a coating chamber that opens toward the backing roller, that extends over the operating width, and that has a slot, demarcated at the web-intake end by an overflow plate, for supplying liquid coating, and a flow-control system at the downstream end of the device, the improvement comprising means defining a coating-guide channel:

that extends over the operating width of the coating chamber and terminates just upstream of the flow-control system;

that is demarcated at one end by the backing roller and at the other by a baffle that essentially parallels the surface of the backing roller;

that extends along the direction of travel of the web at least about 50% of the distance between the overflow plate and the flow-control system;

that its width is from about 1.5 to 15% of its length; and that terminates just upstream of the flow-control system.

2. A device as in claim 1, including means defining a channel for the excess coating doctored off in the flow-control system to flow out through and beginning at an acute angle to the opening between the baffle and the flow-control system.

3. A device as in claim 2, wherein the outflow channel communicates with the intake through which fresh liquid coating is supplied.

4. A device as in claim 3, wherein the outflow channel opens into the coating chamber at an acute angle to the opening into the supply slot.

5. A device as in claim 1, wherein the distance between the end of the baffle and the flow-control system is about 1.2 to 3 times the distance between the baffle and the surface of the backing roller or web of material.

6. A device as in claim 1, wherein the baffle comprises a hollow component that extends over the operating width between the coating chamber and the outflow channel, communicates with the coating chamber through a slot-like opening, opens into the lines that supply fresh liquid coating, and has a surface that demarcates it from the backing roller.

7. A device as in claim 1, wherein the flow-control system includes a doctor blade, a doctor beam in which the doctor blade is secured, and means for pivoting the beam around the point of the doctor blade.

8. A device as in claim 1, wherein the flow-control system includes a doctor batten resiliently secured in a pivotable mount.

9. A device as in claim 1, wherein the flow-control system includes a rotatable doctor rod resiliently secured in a mount.

* * * * *

UNITED STATES PATENT AND TRADEMARK OFFICE

CERTIFICATE OF CORRECTION

PATENT NO. : 4,920,913

DATED : May 1, 1990

INVENTOR(S) : Knop et al.

It is certified that error appears in the above-identified patent and that said Letters Patent is hereby corrected as shown below:

| | |
|---|---|
| Title Page | U.S. PATENT DOCUMENTS: Delete " 3,633,292 " and substitute -- 3,663,292 -- |
| Title Page | FOREIGN PATENT DOCUMENTS: Delete " 3446526 " and substitute -- 3446525 -- |

Signed and Sealed this

Fifth Day of November, 1991

*Attest:*

HARRY F. MANBECK, JR.

*Attesting Officer*

*Commissioner of Patents and Trademarks*